United States Patent [19]

Glasser et al.

[11] Patent Number: 4,711,979

[45] Date of Patent: Dec. 8, 1987

[54] MICROWAVE OVEN VIDEO VIEWING DEVICE

[75] Inventors: George M. Glasser, Irvington; Robert P. DeRobertis, Mahopac; John H. Smithwrick, Mt. Vernon; William J. Kelly, Tarrytown, all of N.Y.

[73] Assignee: General Foods Corporation, White Plains, N.Y.

[21] Appl. No.: 834,090

[22] Filed: Feb. 27, 1986

[51] Int. Cl.[4] ..... H05B 6/76

[52] U.S. Cl. ..... 219/10.55 D; 219/10.55 R; 358/98; 358/100

[58] Field of Search ..... 219/10.55 D, 10.55 F, 219/10.55 M; 358/98, 100, 110, 111; 128/4, 6; 174/35 MS

[56] References Cited

U.S. PATENT DOCUMENTS

| | | | |
|---|---|---|---|
| 3,041,393 | 6/1962 | Hennig | 358/100 |
| 3,609,236 | 9/1971 | Heilman | 358/100 |
| 4,424,531 | 1/1984 | Elter et al. | 358/100 |
| 4,539,588 | 9/1985 | Ariessohn | 358/100 |

FOREIGN PATENT DOCUMENTS

| | | | |
|---|---|---|---|
| 1141529 | 12/1962 | Fed. Rep. of Germany | 358/100 |

*Primary Examiner*—A. D. Pellinen
*Assistant Examiner*—L. K. Fuller
*Attorney, Agent, or Firm*—Thomas A. Marcoux; Thomas R. Savoie; Daniel J. Donovan

[57] ABSTRACT

A microwave viewing device and, more particularly, an arrangement facilitating the internal viewing of a microwave oven during the preparation of a food product or the like in a microwaving process. The viewing device incorporates a tubular support which is extendable through an opening formed in a side wall of a microwave oven, and which extends into close proximity to a food product being subjected to microwave processing in the oven. The viewing device includes a member constituted of telescopable tubular sections; in essence, which member is adapted to be varied in length by adding or removing sections, in dependence upon the size of the food product contained in the microwave oven, and which includes grid structure for supporting an optical viewing device within and in coaxial relationship with the tubular member; with the optical viewing device, such as an endoscope, fiberscope, boroscope or the like, being conducted outwardly from the microwave oven into operative interconnection with a suitable photographic or video recording apparatus. Within the tubular member, the viewing device, which is hereinafter generally referred to as an endoscope, is supported in concentric and coaxial relationship therewith through the interposition, in the annular space between the outer diameter of the shaft of the endoscope and the inner diameter of the tubular member of at least one transversely extending aperture disc component having a plurality of grid-forming through holes provided therein, and which will to a considerable degree reduce the leakage of microwave from the interior of the microwave oven.

13 Claims, 6 Drawing Figures

MICROWAVE OVEN VIDEO VIEWING DEVICE

BACKGROUND OF THE INVENTION

1. Field of the Invention

The present invention relates to a microwave viewing device and, more particularly, relates to an arrangement facilitating the internal viewing of a microwave oven during the preparation of a food product or the like in a microwaving process.

The preparation and development of food products through microwaving in a microwave oven, especially in connection with experimental programs, frequently necessitates that there be afforded the ability of an uninterrupted or continual viewing of the food product during the microwaving process, in order to ensure that the food products are being prepared for consumption under optimum temperature conditions and microwaving periods. Concerning the foregoing, it is important during the development and preparation of such microwave processed foods, that the swelling, shrinking, dehydration, denaturing, cooking, coagulation and the various food ingredients or constituents can be fully and unobstructedly viewed and continually studied during their microwave processing. The viewing of such foods which are in a state of being microwaved through the generally transparent or transluscent access door of a microwave oven has proven itself to be inadequate in practice for the obtaining of accurate experimental data, and in order to obtain more precise information with respect to the effects of microwaving on the foods, it is important that viewing thereof during the microwaving process be effected internally of the microwave oven in close and unobstructed proximity to the food product. One of the difficulties encountered in implementing such an internal viewing procedure during microwaving has been the leakage to the environment of microwaves through an aperture formed for any viewing instrument which is inserted into the microwave oven during the microwaving process, which can readily reach levels at which it is extremely harmful to personnel operating the viewing devices, and moreover, may damage or even destroy any viewing devices, such as photographic or video recording equipment which are connected to such internal microwave viewing devices. Although various types of devices and arrangements have been developed in the technology for monitoring the internal conditions of a microwave oven during microwave processing, none of these have been found to be fully satisfactory in implementing the continual internal viewing of a food product, which is being prepared for consumption or experimental development in the microwave oven, through the positioning of a viewing device in close proximity to the food product being processed within the microwave oven, wherein the optics of such a viewing device are connected to either a photographic or video recording arrangement located externally of the microwave oven, and which would inhibit the danger of any deleterious microwaves leaking to the environment from within the microwave oven, or would prevent damage to the viewing device or its components by the microwaves.

2. Discussion of the Prior Art

Hough U.S. Pat. No. 3,594,531, describes an internally viewable microwave induction heater in which an attachment is fastened to a microwave unit, the attachment consisting primarily of screen components inhibiting the passage of microwaves therethrough to the environment. However, there is no disclosure of the positioning of a viewing probe or optical arrangement internally of a microwave oven in close proximity to a food product being microwaved so as to enable closeup and continuous monitoring of the food product without encountering any leakage of the microwaves which would conceivable damage optical viewing equipment.

White U.S. Pat. No. 3,536,129, discloses an arrangement for conducting a coolant into the chamber of a microwave oven in which various water-bearing substances, such as foodstuffs in a frozen state, are conditioned for thawing. There is no disclosure of any viewing device being positioned in close proximity to the material being processed within the microwave unit which will allow for the constant photographic or video viewing of the material while concurrently inhibiting the escape to the surroundings of any microwaves which may be harmful to the optics of a viewing arrangement and to any personnel in close proximity to the microwave unit.

Dehn U.S. Pat. No. 4,237,731, describes a temperature sensing probe for microwave ovens in which the probe is introduceable into a microwave through a wall opening and insertable into foods being microwave processed therein. However, the device disclosed in this patent does not readily lend itself to modifications for the continual and closeup optical viewing in the changing conditions and physical state of the food being microwave-processed, and is provided merely for the purpose of temperature sensing to supply information over the degree of cooking or doneness of the food product.

Silvermann, et al. U.S. Pat. No. 3,474,210, describe an access construction for microwave chambers or ovens in which a passageway incorporates blocking means for preventing microwaves from leaking from the interior of the microwave chamber into the environment. However, there is no disclosure of any structure which will enable an optical viewing device to be introduced into the microwave chamber so as to extend into close proximity with a food product being microwave-processed, and which incorporates components for inhibiting the escape or leakage of microwaves from the microwave chamber tending to damage or even causing destruction of the optics of the viewing device; and/or posing physical dangers to operating personnel.

Birk U.S. Pat. No. 4,292,488, discloses an access door structure for a microwave oven in which a transparent or transluscent door surface portion is essentially constituted of glass, and incorporates a flexible metal grid or screen therein providing a screening effect inhibiting leakage therethrough of any microwave radiation. However, there is no disclosure of imparting a protective screening to a viewing device which is inserted into a microwave oven chamber through an opening formed in a wall of the microwave oven, and which possesses delicate optics extending into close proximity with the food product being microwaved, wherein the device would incorporate screening structure protecting it from damage from microwave radiation.

SUMMARY OF THE INVENTION

Accordingly, in order to ameliorate or obviate the shortcomings and limitations which are encountered in the prior art with regard to safeguarding devices or arrangements employed for the continual internal viewing of a food product being microwave processed within a microwave oven, from the deleterious effects of any microwave leakages, the present invention provides for a viewing device incorporating a tubular support which is extendable through an opening formed in a side wall of a microwave oven, and which extends into close proximity to a food product being subjected to microwave processing in the oven. The viewing device comprises a member constituted of telescopable tubular sections; in essence, which member is adapted to be varied in length by adding or removing sections, in dependence upon the size of the food product contained in the microwave oven, and which includes grid structure for supporting an optical viewing device within and in coaxial relationship with the tubular member; with the optical viewing device, such as an endoscope, fiberscope, boroscope or the like, being conducted outwardly from the microwave oven into operative interconnection with a suitable photographic or video recording apparatus. Within the tubular member, the viewing device, which is hereinafter generally referred to as an endoscope, is supported in concentric and coaxial relationship therewith through the interposition, in the annular space between the outer diameter of the shaft of the endoscope and the inner diameter of the tubular member, of at least one transversely extending aperture disc component having a plurality of grid-forming through holes provided therein, and which will to a considerable degree reduce the leakage of microwave from the interior of the microwave oven.

Moreover, pursuant to an important inventive feature, arranged with the tubular member, spaced in front of the end of the endoscope within the microwave oven, a mesh structure extends across the opening of the tubular member so as to act as an initial radiation screen preventing any microwaves leaking to the endoscope which would tend to damage or destroy the delicate fiber optics and lens system thereof and which would simultaneously minimize the leakage of radiation to the environment which would be hazardous to humans.

In accordance with a further feature of the invention, a cooling medium, such as cooling air supplied from an external source; for example, chilled compressed air, or the internal air-circulation fan of the oven, may be employed for cooling of the telescopable tubular member through the passage of cooling air interiorly thereof within the annular space between the endoscope and tubular member, to thereby also assist in protecting the optics of the endoscope and increasing the overall life expectancy of the viewing device components.

Accordingly, it is a general object of the present invention to provide a novel viewing arrangement which is adapted for the continual internal viewing of a food product being subjected to microwave processing in a microwave oven.

A more specific object of the invention resides in the provision of an internal video viewing arrangement incorporating tubular structure extending into the chamber of a microwave oven, into close proximity to a food product being microwave-processed, through an opening formed in a wall of the microwave oven, and which incorporates a protective arrangement against microwave leakage for an endoscope supported within the tubular structure and extending closely to the food product.

Still another object of the invention is to provide an arrangement of the type described hereinabove wherein suitable grids and a mesh are incorporated within the tubular structure, in which the grids act as supports for the endoscope while concurrently inhibiting the leakage therethrough of microwaves, and wherein the mesh is arranged spaced in front of the inwardly extending end of the tubular structure and preventing leakage of microwave radiation to the endoscope by forming a radiation screen against any microwaves which can conceivably damage or even destroy the fiber optics lens system of the endoscope.

A further object of the present invention resides in the provision of an arrangement of the type described hereinabove which incorporates structure enabling the viewing device to be cooled from either an external source of a cooling medium or by the internal circulating fan of the microwave oven, which will additionally protect the optics of the endoscope or the viewing device from any heat generated in the microwave oven.

BRIEF DESCRIPTION OF THE DRAWINGS

Reference may now be had to the following detailed description of an exemplary embodiment of the inventive device or arrangement for the internal viewing of a food product which is under preparation in a microwave oven, taken in conjunction with the accompanying drawings; in which.

DETAILED DESCRIPTION

Figure 1:
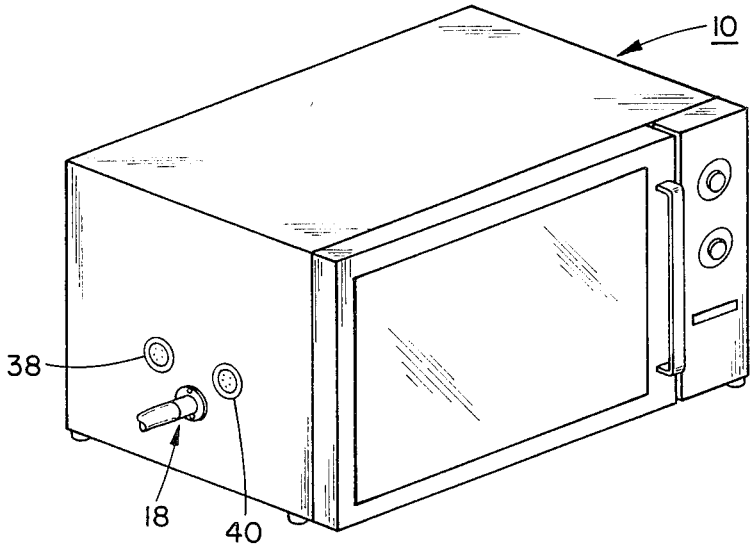
FIG. 1 illustrates a perspective view of a microwave oven incorporating the inventive arrangement for the internal viewing of a food product processed therein.
Figure 2:
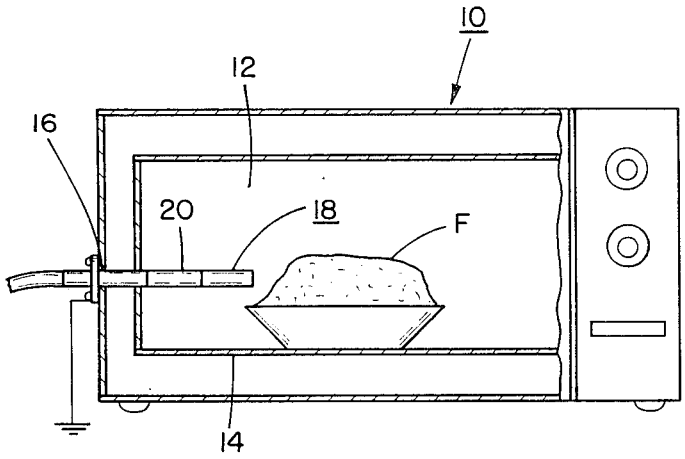
FIG. 2 illustrates a transverse cross-sectional view of the inner chamber of the microwave oven with the viewing arrangement shown mounted thereon in operative position.
Figure 3:
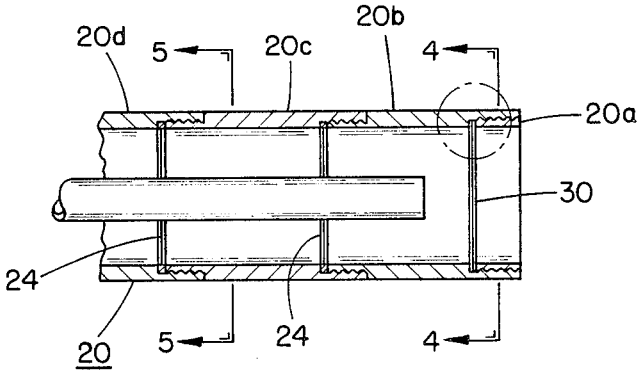
FIG. 3 illustrates, on an enlarged scale and in a longitudinal sectional view, forward end of the inventive internal viewing arrangement which extends into the microwave oven.
Figure 5:
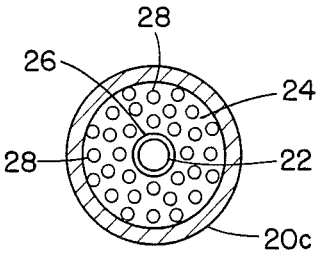
FIG. 5 illustrates a sectional view taken along line 5—5 in FIG. 3.

Referring now in detail to the drawings, and particularly FIGS. 1 and 2, there is illustrated a microwave oven 10 which may be basically a standard commercial or household oven unit, and which possess an inner chamber 12 providing a support surface 14 for a food product F which is to be subjected to a microwaving process. The housing of the microwave oven 10 is provided with at least one aperture 16 in a side wall thereof which will facilitate the insertion therethrough of an internal viewing device or arrangement 18 constructed pursuant to the present invention.

Figure 6:
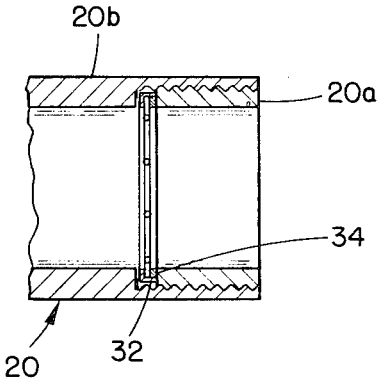
FIG. 6 illustrates, on a still further enlarged scale, the encircled fragmentary portion in FIG. 3 showing the fixed positioning of the mesh structure within the tubular member of the arrangement.

The arrangement 18 for the internal viewing of the food product F in the microwave oven 10, essentially comprises an elongated tubular member 20 which, in the present instance, is constituted of a plurality of interconnectable telescopable tubular sections 20*a*, 20*b*, 20*c*, and the like, which are assembled in threaded engagement through the provision of cooperating female and male screwthreads formed at the ends thereof, as is more clearly shown in FIG. 6 of the drawings. Thus, the term "telescopable" refers to the changeability in the overall length of the tubular member 20 extending into the microwave oven 20, through the juncture of any desired number of tubular sections 20*a*, 20*b*, 20*c* at seq. which extend into the microwave oven 10, in dependence upon the size of the food product F contained therein, and the proximity to the food product with which the leading end of the forwardmost tubular section 20*a* is to extend into the microwave oven. Generally, although not necessarily, each tubular section may be constituted of a brass material having a one-inch external diameter, and equipped with female screw threads at one end and male screw threads at the other end thereof so as to be able to threadingly engage with an adjoining tubular section.

Located in a coaxial and concentric position within the sections of the tubular member 20 is an optical viewing device, such as an endoscope, a fiberscope or boroscope (hereinafter referred to as endoscope) which has its fiber optics extend into close proximity to the forward or leading end of the tubular member 20; in essence, into the region of the leading tubular section 20*a*. The endoscope 22 is maintained in a concentric relationship within the tubular member 20 through the interposition of transverse axially spaced apertured discs 24 forming grids which are each respectively clamped into fixed position between adjoining tubular segments 20*b*, 20*c*, 20*d*, and so forth. Each of the discs 24 has a central aperture 26 which is slightly larger in diameter than the outer diameter of the cylindrical shank of the endoscope 22 passing therethrough so as to allow the latter axial adjustment. Moreover, each disc 24 is provided with a large number of openings 28 extending about the annular space between the inner diameter of the tubular member 20 and the endoscope 22, so as to impart a grid-like structure to each disc.

Figure 4:
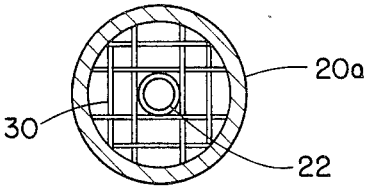
FIG. 4 illustrates a sectional view taken along line 4—4 in FIG. 3.

Towards leading end of the tubular member 20, arranged in a clampingly fixed position between the tubular sections 20*a* and 20*b* is a mesh structure extending transversely in front of the leading end of the endoscope 22, as shown in FIG. 4 of the drawings, which will inhibit the leakage of microwaves from the microwave oven through the interior of the tubular member 24 to the endoscope and to the outside of the microwave oven. The mesh structure 30, as more closely illustrated in FIG. 4 of the drawings, provides a geometric lattice work of a predetermined size which is approximately less than one-half of a wavelength which will enable the focusing optics at the leading end of the endoscope 22 to remain visually unobstructed during viewing of the food product F which is subjected to microwave processing in the microwave oven 10. Accordingly, the mesh structure 30 constitutes a visually unobstructive microwave radiation leakage-preventing screen in front of the leading end of the endoscope 22.

As illustrated in the detail of FIG. 6 of the drawings, the mesh structure 30 is clamped about its outer circumference between the two leading tubular sections 20*a* and 20*b* of the tubular member 20, and particularly intermediate the mating end surfaces of the tubular sections formed by the cooperating male and female screwthreads, through the interposition of an, in cross-section, generally L-shaped ring flange 32, and clamped in surface contact against the angled portion thereof through a cooperating annular ring member 34 on the opposite side of the mesh structure, which is forced thereagainst by the threaded engagement between the sections 20*a*, 20*b*. A similar clamping arrangement is provided for each of the grid-like discs 24 between, respectively, tubular sections 20*a*, 20*b*; 20*c*, 20*d*, and the like.

The tubular member 20 which extends into the microwave oven through the opening 16 provided in the side wall of the microwave oven 10, is fastened to the side wall of the oven by means of a flange 36 which is fixed to and encompasses the tubular member 20, and thereafter attached through suitable screw fasteners (not shown) to the outer wall of the microwave oven 10. Any paint on the microwave oven surface at that location is removed in order to provide an electrically-conductive metal-to-metal contact, with the flange 36 being grounded so as to cause the entire viewing system to become a part of the operating system of the microwave oven.

As set forth hereinbefore, and as illustrated, the tubular member 20 may be constituted of a suitable good heat conductive material, such as copper or brass, or similar heat conducting yet rigid material and consists of a plurality of interconnectable tubular sections 20*a*, 20*b*, 20*c*, 20*d*, and so forth, each of the grid-like discs 24 having a large number of openings 28, which may each be approximately one-eighth inch in diameter; in essence, standard microwave aperture size. Also the tubular member 20 may be made up of plastic in which case it is not necessary for it to be a good heat conductor, but it is necessary for it to maintain its rigidity. The central aperture 26 of each disc 24 is slightly larger in size than the outer diameter of the shank of the endoscope 22, the latter of which may be preferably an 8-millimeter endoscope, although other sizes, such as 6-millimeter, 12-millimeter and 16-millimeter and the like may also be readily employed, the endoscope being generally of a size within the range of about 6–16 millimeters; although an optimum preferred size for ready movement and light projection is generally about 8-millimeters.

The mesh structure 30, as described in FIG. 4, may consist of a 8 mm square grid of metallic wires, with each wire being about 0.25 millimeters in thickness. This mesh lattice acts as a primary barrier component in inhibiting microwave radiation from escaping or leaking from the interior of the microwave oven into the tubular member encompassing the endoscope 22 so as to protect the latter. Moreover, the mesh 30 acts as a mechanical protective barrier which will restrain any microwaved food product F, such as puffed foods, from moving, pushing and expanding during the puffing thereof from entering the leading tubular section 20*a* past the mesh structure, wherein such entry could possibly impact damage to the fragile optical and luminal qualities of the video endoscope 22. Preferably, the surface of the fine wire mesh structure is provided with a coating of a flat black paint in order to render the mesh "virtually invisible" to the optics of the endoscope because of the focusing characteristics of the endoscope. Moreover, the approximately 0.25 millimeter thinness of the wire employed for the mesh structure 30 permits the endoscope 22 to focus through the lattice of the wire mesh.

The grid-like discs 24 provide a support for the elongated flexible shaft or shank portion of the endoscope 22 at a concentric coaxial relationship in the telescopable tubular member 20 when inserted into the microwave oven 10. Moreover, the numerous openings 28 in the discs 24 act as a backup protection to further restrict any microwave radiation from leaking through the tubular member 20 from the microwave oven 10. The only slightly larger central aperture 26 in the discs 24 relative to the outer diameter of the endoscope 22 allows for the ready axial movement or positioning of the endoscope without any microwave radiation leakage being encountered therethrough.

The side wall of the microwave oven 10 containing the opening 16 may also be provided with two further openings 38 and 40 at suitable locations, such as 1 inch diameter holes with punched steel coverings having standard ⅛ inch microwave apertures therein, for the attachment of external fiber optic lighting for the cavity of the microwave oven without microwave radiation leakage from the oven. Preferably, the two further openings which provide external lighting for the microwave should be in close proximity to the microwave viewing arrangement 18. In one preferable system, the openings 38 and 40 were two inches to the left and right respectively and ¾ inch above the microwave viewing arrangement 18. The close proximity allows light to impinge on the subject under study and as the subject, i.e. food expands, contracts or moves in some fashion during cooking, the light can be adjusted to fully illuminate the changing subject.

With the inventive microwave viewing arrangement 18 being inserted through the aperture 16 in the wall of the microwave oven 10, and a heavy load placed in the microwave 10, no radiation leakage is detected at the side wall opening 16. With the viewing arrangement 18 left off, and under a heavy load in the oven, there would be generally encountered a 3–4 milliwatt radiation loss to atmosphere with a light load (low moisture product, small portion size), the risk of encountering severe radiation losses to atmosphere is quite apparent.

If necessary, the annular space between the shank portion of the endoscope 22 and the inner diameter of the tubular member 20 may be supplied with a flow of a cooling medium, such as externally-supplied cooled air or compressed air, or air supplied from a circulating fan system contained within the microwave oven.

Finally, it is possible to provide the internal and/or external surface of the tubular member 20 with ridges or grooves so as to increase the surface area thereof and facilitating enhanced cooling of the tubular member 20 and of the endoscope 22.

From the foregoing it readily appears that the invention relates to an extremely versatile internal viewing system for microwave ovens, which may be readily connected at the outer end of the endoscope to a suitable photographic or video recording arrangement so as to provide for the continuous and permanent record of physical changes in the food product which is being subjected to microwave processing in the microwave oven.

While there has been shown and described what are considered to be preferred embodiments of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

We claim:

1. An arrangement for the internal viewing of the preparation of a food product or the like in a microwave oven; comprising a telescopable tubular member insertable through an aperture in a wall of said microwave oven so as to position the leading end of said tubular member in proximity to the food product in said microwave oven; a generally cylindrical optical viewing device being inserted in said tubular member in coaxially concentric relationship therewith, said viewing device having an outer diameter which is smaller than the inner diameter of said tubular member to form an annular space therebetween; at least one ring-shaped apertured disc extending transversely in the space between said viewing device and said tubular member for radially supporting said device within said tubular member; and a mesh structure being positioned in said tubular member to extend transversely in front of the leading end of said viewing device in said microwave oven so as to form a radiation screen inhibiting the leakage of microwave radiation therethrough.

2. An arrangement as claimed in claim 1, wherein said mesh structure has a lattice-forming wire matrix facilitating unobstructed viewing of said food product in said microwave oven by said optical viewing device.

3. An arrangement as claimed in claim 1, wherein said tubular member, aperture disc and mesh structure are formed of an electrically-conductive metal, such as aluminum, copper or brass.

4. An arrangement as claimed in claim 1, wherein said grid-like disc comprises a radiation screen inhibiting leakage of microwave radiation from said microwave oven.

5. An arrangement as claimed in claim 1, comprising means for conveying a cooling medium through said annular space between the viewing device and tubular member to cool said viewing device from heat generated in said microwave oven.

6. An arrangement as claimed in claim 1, wherein said viewing device comprises an endoscope possessing a fiber optic lens system.

7. An arrangement as claimed in claim 6, wherein said endoscope has an optical lens viewing diameter within the range of about 6–16 mm.

8. An arrangement as claimed in claim 6, wherein said endoscope lens diameter is about 8 mm.

9. An arrangement as claimed in claim 8, wherein the opening size of said mesh structure is about 8 mm square to allow for unobstructed viewing through said endoscope.

10. An arrangement as claimed in claim 1, wherein said tubular member comprises a plurality of coaxial tubular sections in threaded interconnection to impart the desired length to said tubular member.

11. An arrangement as claimed in claim 10, wherein respectively one of said apertured discs is clamped between the junctures of each of said tubular sections so as to form a plurality of axially spaced supports for said viewing device in said tubular member.

12. An arrangement as claimed in claim 11, comprising annular flange means and a ring-shaped element for retaining the outer circumference of said mesh structure and each of said discs therebetween, and the contacting end surfaces of said tubular sections imparting an axial clamping force to said components.

13. An arrangement as claimed in claim 1, comprising further openings in the side walls of said microwave oven for connection of external fiber optic means for lighting the interior of said microwave oven.

* * * * *